United States Patent [19]

Kobayashi et al.

[11] Patent Number: 4,887,943

[45] Date of Patent: Dec. 19, 1989

[54] GAS COMPRESSOR OF VARIABLE VOLUME

[75] Inventors: Takeshi Kobayashi; Junichi Asai, both of Narashino, Japan

[73] Assignee: Seiko Seiki Kabushiki Kaisha, Chiba, Japan

[21] Appl. No.: 902,421

[22] Filed: Aug. 29, 1986

[30] Foreign Application Priority Data

Aug. 30, 1985 [JP] Japan ..... 60-191477

[51] Int. Cl.[4] ..... F04B 49/02; F04C 29/08

[52] U.S. Cl. ..... 417/295; 417/310

[58] Field of Search ..... 417/295, 299, 304, 310; 418/78; 62/228.5, 217

[56] References Cited

U.S. PATENT DOCUMENTS

| | | | |
|---|---|---|---|
| 3,120,814 | 2/1964 | Mueller | 418/159 |
| 3,224,662 | 12/1965 | Oldberg | 417/304 |
| 3,418,937 | 12/1968 | Cardillo et al. | 417/270 |
| 3,451,614 | 6/1969 | Tosh | 417/440 |
| 4,060,343 | 11/1977 | Newton | 418/78 |
| 4,137,018 | 1/1979 | Brucken | 417/440 |
| 4,330,999 | 5/1982 | Nakayama | 62/217 |
| 4,421,462 | 12/1983 | Ohe | 417/310 |
| 4,557,670 | 12/1985 | Finagaki | 417/310 |
| 4,566,863 | 1/1986 | Goto | 417/310 |
| 4,580,950 | 4/1986 | Sumikawa | 417/295 |
| 4,726,740 | 2/1988 | Sozoki et al. | 417/310 |

FOREIGN PATENT DOCUMENTS

| | | | |
|---|---|---|---|
| 174516 | 3/1986 | European Pat. Off. | 418/76 |
| 2057750 | 6/1971 | Fed. Rep. of Germany . | |
| 1291334 | 10/1972 | United Kingdom . | |

*Primary Examiner*—William L. Freeh

*Attorney, Agent, or Firm*—Bruce L. Adams; Van C. Wilks

[57] ABSTRACT

A rotary compressor is comprised of a first housing having an intake chamber for receiving therein a fluid of variable pressure, and a second housing having an inner peripheral surface to define a working chamber and an inlet communicating between the working and intake chambers. A rotor is rotatably mounted in the working chamber and has a vane slidably supported in the rotor to maintain contact with the inner peripheral surface of the second housing during the rotation of the rotor to thereby compress the fluid flowing into the working chamber through the inlet. A rotary valve is rotatably disposed between the intake chamber and working chamber for regulating the flow rate of the fluid flowing through the inlet in response to angular displacement of the rotary valve. A piston is slidably disposed in a cylinder provided in the first housing. The piston has a front end exposed to the fluid in the intake chamber through one opening of the cylinder and a rear end exposed to the outside through the other opening of the cylinder so that the piston undergoes linear displacement in the cylinder in response to the variable fluid pressure applied to the front end of the piston. The linear movement of the piston is converted by a mechanical link into the angular displacement of the rotary valve.

20 Claims, 6 Drawing Sheets

GAS COMPRESSOR OF VARIABLE VOLUME

BACKGROUND OF THE INVENTION

The present invention relates to a gas compressor for use in a car cooler and, more particularly, to a gas compressor in which the capacity of its compression chamber is made variable.

Usually, a gas compressor used for cooling an automobile or the like is arranged in parallel with an engine so that the gas compressor is driven through a V-belt by the crankshaft pulley of the engine, and the gas compressor is connected to or disconnected from the drive side means of an electromagnetic clutch which is disposed in the compressor side.

As a result, the capacity of the gas compressor of the above-specified type is increased in proportion to the r.p.m. of the engine. This in turn causes the gas compressor to be driven at a high speed, in case the automobile runs at a high speed, thereby to over-cool the automobile compartment and to raise a defect that the power consumption is increased in proportion to the running speed. This tendency is serious especially in the gas compressor of rotary type.

In order to eliminate this defect, there have been proposed a variety of the so-called "volume-variable type" gas compressors in which the volume of a coolant gas in the compression chamber is regulated in accordance with the driving speed.

For example, the volume of the coolant gas is made variable by controlling the opening of a bypass hole, which is formed in a position suitably displaced in the rotational direction of a rotor with respect to an intake port.

In the gas compressor of this type, however, the coolant gas once confined in the compression chamber is bypassed to an intake side after the coolant gas has been compressed to some extent. Therefore, the gas compressor has an inferior compression efficiency and a drawback that the discharge temperature of the coolant gas rises especially at the high-speed, i.e., small-volume run.

Incidentally, the gas compressor developed in recent years is of the type, in which the volume of an intake to be sucked from an intake fluid port of a front side block of the compressor is made variable by mounting a rotary plate in the front side. The rotary plate is formed with a recess communicating with the intake port, and by rotating the rotary plate a predetermined angle the volume of the intake fluid is regulated. In the gas compressor of this type, most of the means for controlling the rotary plate are constructed such that the temperature of the air in of the automobile compartment or an evaporator is sensed by means of a thermostat so that the rotary plate can be turned by the drive of a motor attached to the compressor when the temperature drops to or lower than a set level of the thermostat. This raises defects that the construction is complicated and large-sized by the added motor.

For example, in U.S. Pat. No. 4137018, it is disclosed that a control plate is mounted between a cylinder and a front side block, and that the shaft 220 which gears with the control plate 200 drives the control plate 200.

In this mechanism, however, another drive means for driving shaft 220 is needed. Although it is not described in this patent that this mechanism is controlled automatically, if the control plate 200 were controlled automatically, the mechanism would be complex wholly, and would not be simplified and made compact.

SUMMARY OF THE INVENTION

The present invention has been conceived in view of the background described above and contemplates to provide a gas compressor of the so-called "variable volume type", in which the capacity of its compression chamber for confining and compressing a coolant gas is made variable in accordance with the high and low running speeds so that the capacity of the compression chamber is controlled in accordance with the intake pressure in an intake chamber, while a control mechanism therefor is simplified and made compact.

In order to achieve the above-specified object, according to the present invention, there is provided a gas compressor of variable volume which comprises a cylinder (14) formed into a substantially elliptic or round shape; front and rear side blocks (5,6) fixed to the opposite sides of the cylinder; a rotor (9) fitted rotatably in a cylinder chamber (12), which is defined by the cylinder and the two side blocks, the rotor carrying a plurality of vanes (8) enabled to protrude and retract radially from and into the rotor; a compression chamber formed by the vanes in the cylinder chamber; a rotary plate (15) mounted rotatably within a predetermined angular range on the inner face of the front side block, the rotary plate being rotated to continuously move relative to an intake communication port (17) formed in the front side block so that the volume of the fluid introduced into the compression chamber can be made variable in accordance with the running state of the gas compressor; an intake chamber (11) formed by the side block; and driving means for moving rotatably the rotary plate in accordance with the intake pressure in the intake chamber.

DETAILED DESCRIPTION OF PREFERRED EMBODIMENTS

Figure 1:
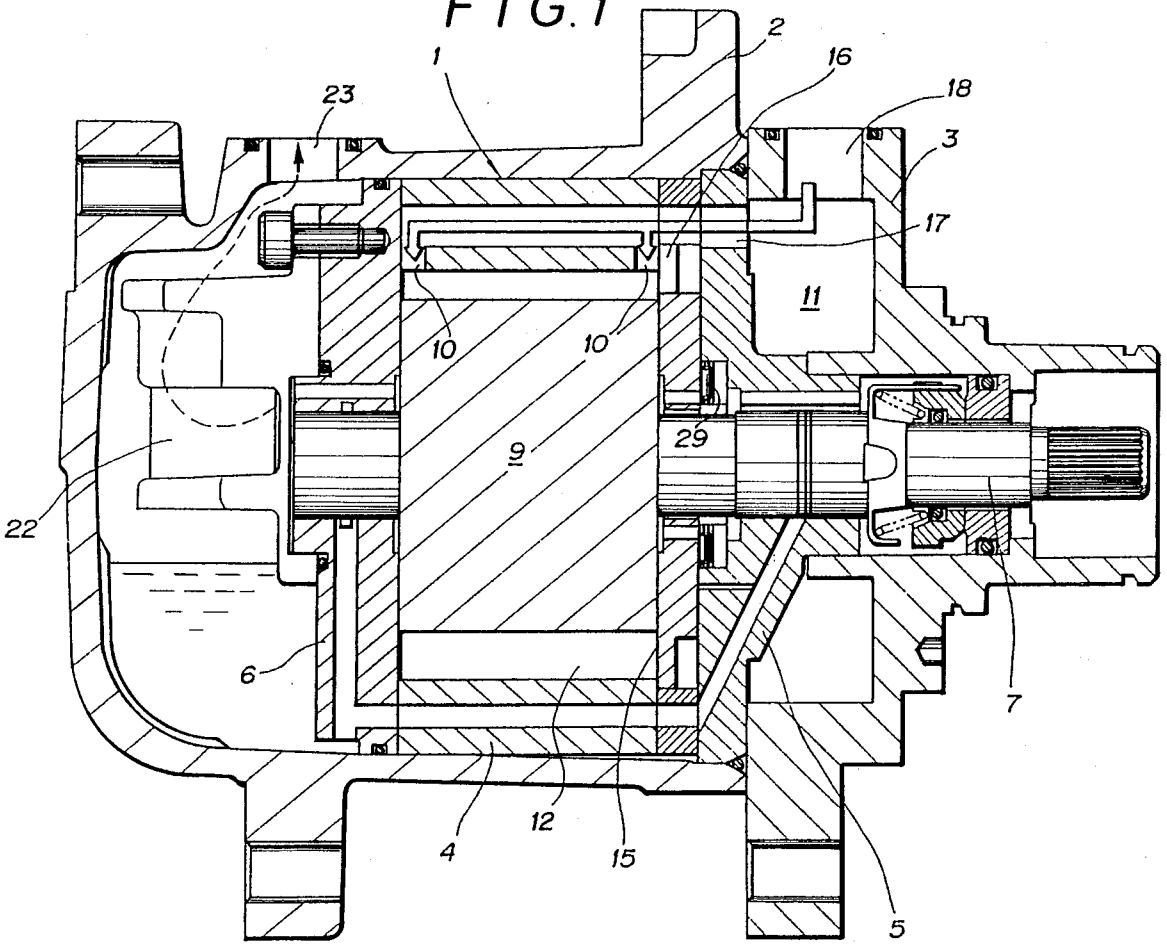
FIG. 1 is a longitudinal section showing the overall construction of the gas compressor according to the present invention.
Figure 2:
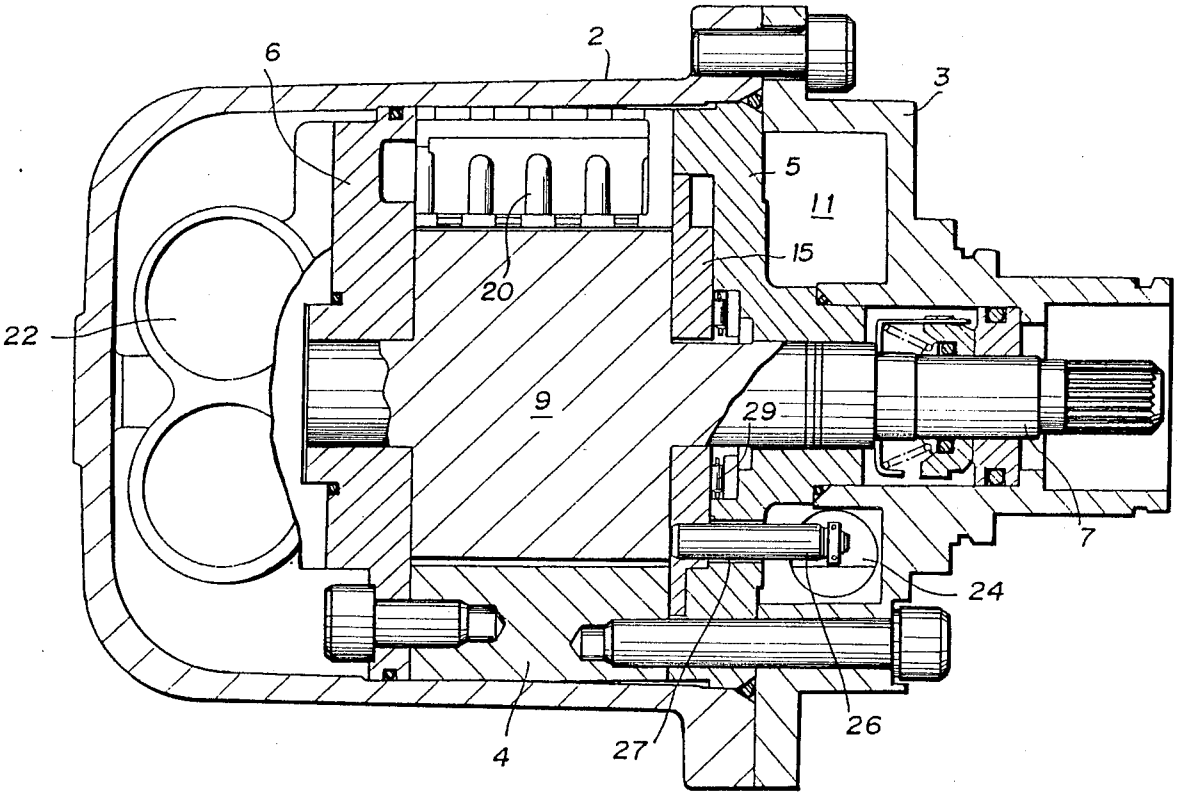
FIG. 2 is a transverse section showing the first embodiment of the gas compressor according to the present invention.

The preferred embodiment of the present invention will be described in detail in the following with reference to the accompanying drawings.

FIGS. 1 to 4 show a first embodiment of the gas compressor to which the present invention is applied.

This gas compressor is comprised of a compressor body hermetically 1, a one-end open type casing 2 hermetically enclosing the body 1 and a front head or second housing 3 fixed to the open end face of the casing 2.

The aforementioned compressor body 1 is composed of a hollow cylindrical body 4 formed to have a generally elliptic inner periphery, and front and rear side blocks 5 and 6 fixed to the opposite sides of the cylindrical body 4. In the elliptic working chamber 12 thus formed, a solid cylindrical rotor 9 is rotatably fitted in a horizontal direction. The solid cylindrical rotor 9 is integrated with a rotor shaft 7 and carries on its outer circumference five vanes 8 disposed slidably to protrude and retract in the radial direction to maintain contact with the elliptic inner periphery during the rotation of the rotor.

On the inner or rear face of the aforementioned front side block 5, on the other hand, a generally disk-shaped rotary value plate 15 is mounted rotatably within a predetermined angular range.

Moreover, the aforementioned rotary valve or disk 15 is formed in its peripheral edge with valve openings or recesses 16 which are disposed between communication holes or inlets 17 formed in the front side of block 5 and the working chamber 12 to regulate the flow rate of a fluid introduced into the working chamber 12 through the inlets 17.

In other words, if the intake pressure of the fluid drops when the gas compressor is running at a high speed, the valve openings or recesses 16 of the rotary plate 15 clockwise to reduce the volume of the fluid introduced into the working chamber 12 to thereby raise the intake pressure. In response to a rise of the intake pressure in a low-speed run, on the other hand, the rotary valve plate 15 can rotate so that the recesses 16 move angularly counterclockwise to maximize the volume of the fluid introduced into the working chamber 12. Incidentally, means for driving the rotary valve plate 15 will be described hereinafter.

Thus, when the rotor 9 is rotationally driven, a fluid or coolant gas, which is introduced under a low pressure from an intake port 18 formed in the front head 3, is sucked, as indicated by solid arrows in FIG. 1, into compression chambers formed between each two adjoining vanes 8 within the working chamber 12 via the pair of communication holes or inlets 17 formed in the front side block 5 in diametrically opposed relation. Then, the gas or fluid is compressed by the rotating vanes 8 in the working chamber to a high pressure and the compressed fluid is supplied through a discharge port 19 and a discharge valve 20 and further through a communication hole 21, which opens to the gap between the outer periphery of cylindrical body 4 and the inner periphery of the casing 2 and which is formed in the rear side block 6 with a phase difference of 90 degrees from the aforementioned communication hole 19, to an oil separator 22 which is formed at the back of the rear side block 6 the compressed fluid is discharged, as indicated by broken arrow in FIG. 1, from the rear space of the casing 2 to the outside through a discharge port 23.

Next, the essential portion of the present invention, i.e., the drive means for driving the rotary valve plate 15 will be described hereafter.

In an intake chamber 11 formed between the front side block 5 and the front head 3, more specifically, there is arranged a piston 24 slidably disposed in a cylinder which extends through the front head 3 at a right angle with respect to the axis of the compressor to open to the intake chamber 11 and to the outside. This, this piston 24 has its one end **24*a* exposed to the fluid in the intake chamber 11 and its other end 24*b* exposed to the outside ambient atmosphere. In the hollow of the piston 24, moreover, there is fitted biasing means comprised of a spring 25 which has a suitable force for always biasing the piston cylinder 24 toward the intake chamber 11 to counterbalance the piston 24 relative to the variable intake pressure applied to the piston end 24*a*. On front the face of the rotary plate 15, on the other hand, there is anchored upright a drive pin or protrusion 26 which extends through a cam groove 27 formed in an arcuate shape in the front side black 5. The leading end 26*a* a the intake chamber 11. This leading end 26*a* of the drive pin 26 is fitted in an engagement recess 28 which is formed in the side of the piston cylinder 24**.

As a result, the piston 24 is caused to linearly protrude and retract by the difference between the force of the spring 25 and the intake pressure of the fluid in the intake chamber 11. In accordance with this linear displacement of the piston 24, moreover, the drive pin 26 fitted loosely in the engagement recess 28 rotates around the axis of the rotary valve plate 15 guided along the cam groove 27, while sliding to the right and left in the engagement recess 28, so that the rotary rotary plate 15 rotates a desired angle guided along the cam groove 27. Thus, in accordance with the variation of the intake pressure of the fluid in the intake chamber 11, the recesses 16 of the rotary plate 15 is displaced relative to the inlets 17 to adjust the effective openings of the inlets 17 to thereby regulate the volume or flow rate of the coolant gas introduced into the compression chamber defined between the outer cylindrical periphery of the rotor 9 and the inner elliptic periphery of the cylindrical body 4 so that the intake pressure of the fluid to be sucked into the compression chamber can always be held at a constant level (which is preferably about 2 $Kg/cm^2$). Incidentally, reference numeral 29 appearing in the drawings denotes a thrust bearing which is mounted on one side of the rotary valve plate 15 to smooth the rotational movement of the rotary valve plate 15.

Figure 3:
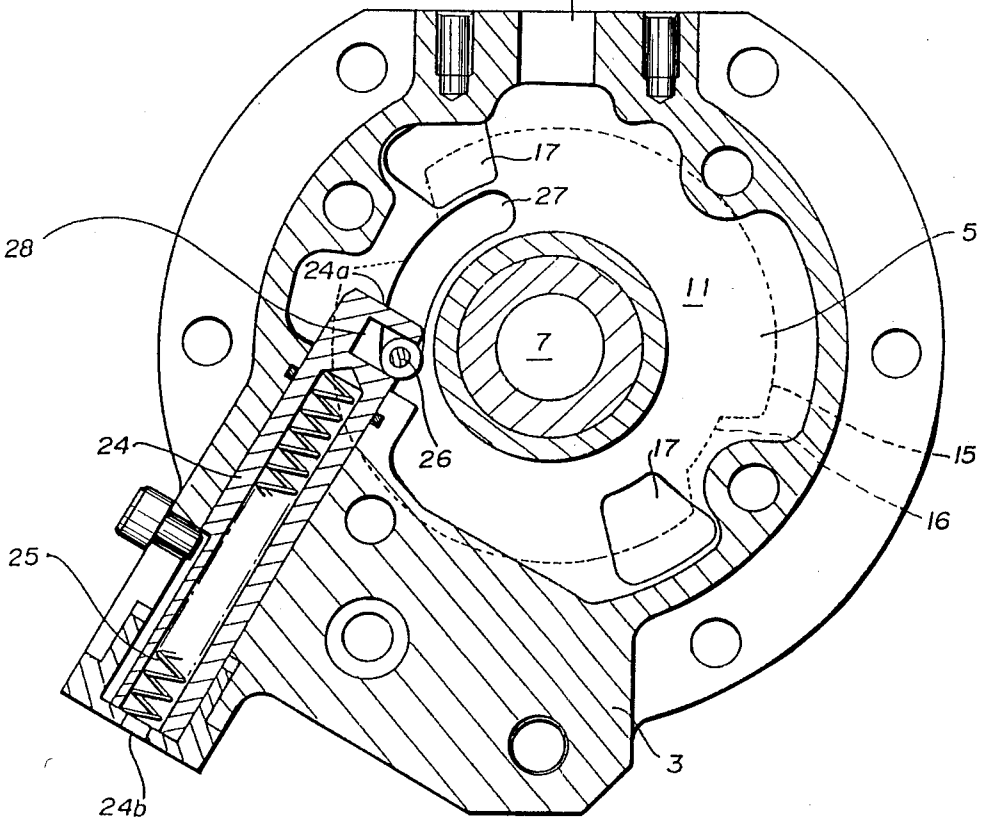
FIG. 3 is a longitudinal section showing the essential portion of the first embodiment.

The spring-biased piston 24, valve plate 15 and the interconnecting structure for angularly displacing the valve plate 15 in accordance with the movement of the piston 24 constitute pressure-responsive valving means for regulating the flow rate of the gas from the intake chamber 11 to the compression chambers in direct response to variable gas pressure in the intake chamber 11. As best seen in FIG. 3, the pressure of the gas within the intake chamber 11 acts directly on the working area of the piston end **24*a* which is in direct communication with the intake chamber 11 thereby urging the piston 24 in the direction tending to displace the valve plate 15 counterclockwise to close or restrict the inlets 17. On the other hand, the spring 25 urges the piston 24 in the opposite direction tending to displace the valve plate 15 clockwise to open the inlets 17, and atmospheric pressure acts on another working area of the piston 24 to assist the biasing force exerted by the spring 25**.

Figure 4:
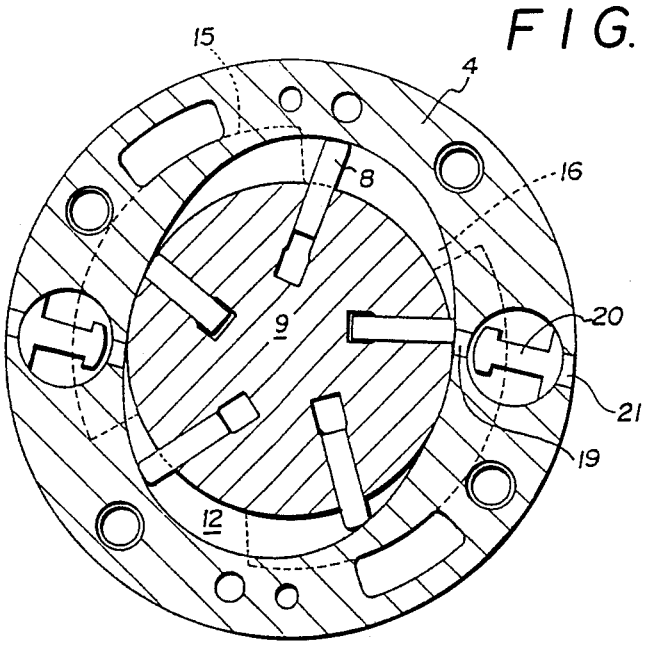
FIG. 4 is a longitudinal section showing the gas compressor when driven in the high-speed run.
Figure 5:
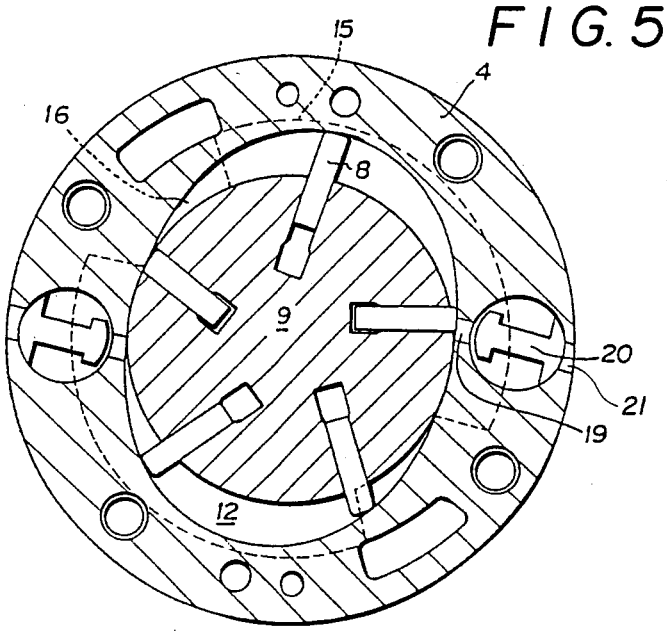
FIG. 5 is a longitudinal section showing the gas compressor when in the low-speed run.

FIG. 4 shows the positional relationship of the recess 16 of the rotary plate 15 relative to the inlets 17 in the minimum valving, and FIG. 5 shows the positional relationship of the recess 16 of the rotary plate 15 relative to the inlets 17 in the maximum valving.

Figure 6:
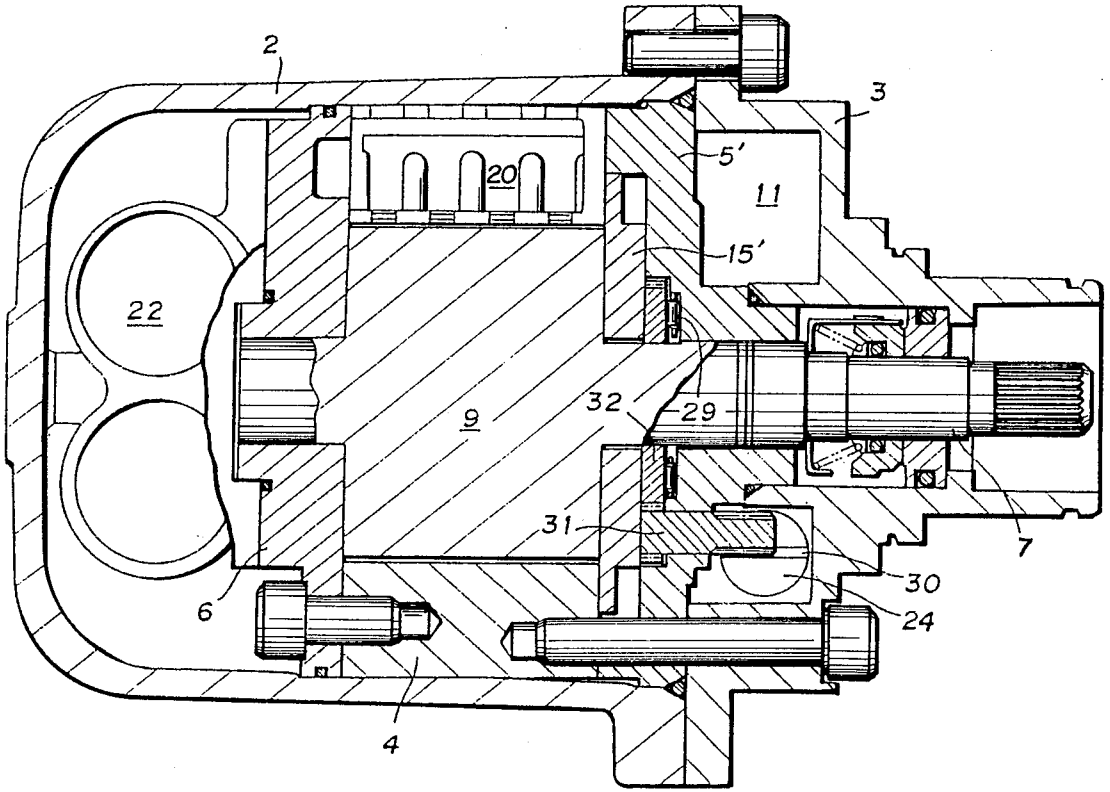
FIG. 6 is a transverse section showing the second embodiment of the gas compressor according to the present invention.
Figure 7:
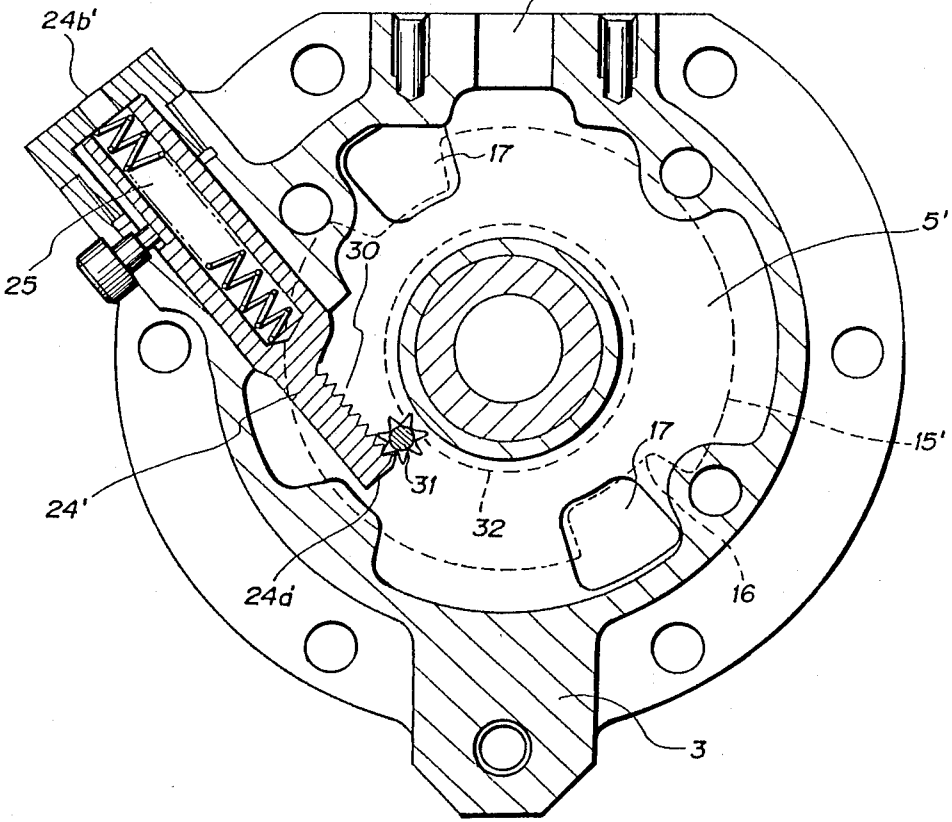
FIG. 7 is a longitudinal section showing the essential portion of the second embodiment.

Next, a second embodiment of the gas compressor according to the present invention will be described with reference to FIGS. 6 and 7. The present embodiment is identical to the foregoing embodiment except the drive means of the rotary valve plate 15, and the following description is directed only to the drive means. In the present embodiment, a piston 24' has, like the foregoing embodiment, its one end 24'a opened to the intake chamber and its other end 24'b opened to the outside and is ambient atmospheric arranged at a right angle with respect to the axis of the compressor in parallel to a valve plate 15. Moreover, this piston 24' has its side formed with a rack portion 30, which is meshed by an intermediate pinion 31. This pinion 31 is mounted rotatably in a hole of a front side block 5 while extending therethrough. On the rotary valve plate 15' at the side facing the front side block 5', on the other hand, there is coaxially mounted a pinion 32 which has a smaller diameter than that of the rotary valve plate disk 15'. This pinion 32 meshes with the aforementioned intermediate pinion 31.

As a result, by the difference between the intake pressure of the fluid in the intake chamber 11 and the spring force of a spring 25, the piston 24' is caused to protrude and retract so that the intermediate pinion 31 meshing with the rack portion 30 is accordingly rotated in the direction of arrow. In accordance with the rotation of the intermediate pinion 31, moreover, the pinion 32 is also rotated so that the rotary valve plate 15' is rotated a predetermined angle because the plate 15' is made integral with the pinion 32.

Like the foregoing embodiment, the intake portion or the effective opening of inlets 17 is continuously adjusted so that the volume of the coolant gas introduced into the compression chamber can be made continuously variable so as to hold the intake pressure at a constant level.

As has been described hereinbefore, the gas compressor according to the present invention is directed to a variable volume type, in which the gas compressor always runs in an optimum capacity by rotating the rotary valve plate mounted on the inner side of the front side block so as to hold the intake pressure at a constant level at all times in accordance with the change in the intake pressure of the intake chamber due to the running condition to thereby control the effective volume for the compression in the cylinder chamber. For this operation, the piston having the built-in spring is provided in the intake chamber and is caused to protrude and retract by the difference between the intake pressure and the spring force thereby to rotate the rotary valve plate. As a result, it is possible to provide a remarkably practical gas compressor which can be free from the problem of the rise in the discharge temperature of the coolant gas in a run of small volume compression, as has been experienced by the volume variable type gas compressor of the prior art. Its construction is made simpler than that of the prior art structure valve in which the rotary valve plate is controlled by the system. The inventive compressor can effect the control of the rotary valve plate compactly because the control does not resort to a motor attached to the compressor.

What is claimed is:

1. A gas compressor of variable volume comprising: a hollow cylindrical body having a substantially elliptic inner peripheral surface; a front side block having a communicating hole and fixed to one side of the cylindrical body; a rear side block fixed to the other side of the cylindrical body; an intake chamber for receiving therein a fluid and for feeding the fluid to a cylinder chamber defined by the cylindrical body and the front and rear side blocks through the communicating hole; a rotor rotatably mounted in the cylinder chamber and carrying a plurality of vanes mounted to slidably protrude and retract radially from and into the rotor to define in the cylinder chamber a compression chamber in which the fluid is compressed; a rotary plate formed with a recess in a peripheral portion thereof and mounted to undergo angular displacement within a predetermined angular range on the inner face of the front side block so as to regulate the flow of the fluid from the intake chamber to the cylinder chamber through the communicating hole; a piston for angularly displacing the rotary plate within the predetermined angular range, one end of the piston being exposed to the intake chamber to be driven in direct response to the intake pressure of the fluid in the intake chamber to angularly displace the rotary plate to thereby vary the position of the recess so that the capacity of the compression chamber can be controlled in accordance with the running state of the gas compressor; and counterbalancing means for counterbalancing the piston relative to the intake pressure applied to said one end of the piston.

2. A gas compressor according to claim 1; wherein the counterbalancing means includes a spring fitted in the piston for urging the piston toward the intake chamber by a predetermined spring force; and including connecting means for connecting the head portion of the piston and the rotary plate to enable the piston to be moved back and forth by the difference between the intake pressure and the force of the spring so that the rotary plate can be angularly displaced a desired angle in accordance with the stroke of the piston.

3. A gas compressor according to claim 2; wherein the connecting means includes a drive pin disposed upright on the surface of the rotary plate, and an engagement recess formed in the side of the piston for loosely receiving therein the drive pin, whereby the rotary plate is angularly displaced through the drive pin with the stroke of the piston.

4. A gas compressor according to claim 2; wherein the connecting means includes a pinion fixed coaxially on the rotary plate, a rack portion formed on the side of the piston, and an intermediate pinion extending rotatably through the front side block and meshing with both of the rack portion and the pinion, whereby the rotary plate is angularly displaced through the intermediate pinion with the stroke of the piston.

5. A rotary compressor comprising: a first housing having an intake chamber for receiving therein a fluid of variable pressure and having a cylinder which communicates at one end with the intake chamber and which communicates at the other end with the outside; a second housing having means therein defining a working chamber having an inner peripheral surface, an inlet communicating between the working and intake chambers, and an outlet; a rotor rotatably mounted in the working chamber and having a vane slidably supported in the rotor to maintain contact with the inner peripheral surface of the second housing during the rotation of the rotor to thereby compress the fluid flowing into the working chamber through the inlet and discharge the compressed fluid from the outlet; valve means rotatably disposed between the intake chamber and working chamber for regulating the flow rate of the fluid flowing through the inlet in response to angular displacement of the valve means; a piston slidably disposed in the cylinder provided in the first housing, the piston having a front portion exposed to the fluid in the intake chamber through one opening of the cylinder and a rear portion communicating with the outside through the other opening of the cylinder; counterbalancing means acting on the rear portion of the piston for counterbalancing the piston relative to the variable fluid pressure applied to the exposed front portion of the piston so that the piston undergoes linear displacement in the cylinder in direct response to the variable fluid pressure applied to the front portion of the piston; and converting means engaged between the piston and the valve means for mechanically converting the linear displacement of the piston into the angular displacement of the valve means.

6. A rotary compressor according to claim 5; wherein the counterbalancing means comprises a spring disposed in contact with the piston rear portion for urging the piston toward the intake chamber against the fluid pressure applied to the piston front portion.

7. A rotary compressor according to claim 6; wherein the piston comprises a hollow piston having a hollow open to the atmosphere and accommodating therein the spring.

8. A rotary compressor according to claim 5; wherein the second housing comprises a hollow cylindrical body having a substantially elliptic inner surface and front and rear openings, a front block mounted on the front opening of the cylindrical body and provided with an inlet, and a rear block mounted on the rear opening of the cylindrical body and provided with an outlet.

9. A rotary compressor according to claim 8; wherein the rotor comprises a cylindrical rotor coaxially rotatably mounted in the hollow cylindrical body of the second housing to define a compression chamber between the outer cylindrical surface of the rotor and the inner elliptic surface of the cylindrical body.

10. A rotary compressor according to claim 9; including a plurality of vanes disposed in the outer cylindrical surface of the rotor for dividing the compression chamber into a plurality of variable spaces in which the fluid is compressed during the rotation of the rotor.

11. A rotary compressor according to claim 8; wherein the first housing comprises a front head opposed to the front block to define therebetween the intake chamber, the front head having an intake port for admitting a fluid into the intake chamber and a cylinder.

12. A rotary compressor according to claim 11; wherein the valve means comprises a rotary disc rotatably mounted on a rear face of the front block in the working chamber, the rotary disc having a recess along the periphery of the rotary disc for regulating an effective opening of the inlet provided in the front block according to the angular displacement of the rotary disc relative to the rear face of the front block.

13. A rotary compressor according to claim 12; wherein the converting means comprises a first pinion coaxially mounted on the front face of the rotary disc, a second pinion rotatably mounted in the front block, the second pinion having a rear end portion engaging with the first pinion and a front end portion protruding into the intake chamber, and a rack provided on the peripheral surface of the piston and engaging with the front end portion of the second pinion.

14. A rotary compressor according to claim 12; wherein the piston comprises a cylindrical piston undergoing the linear displacement in the axial direction thereof in parallel to the rotary disc.

15. A rotary compressor according to claim 12; wherein the converting means comprises an annular cam groove provided in the front block, and a protrusion protruding from the front fact of the rotary disc into the intake chamber through the annular cam groove, the protrusion being engaged with the front portion of the piston to undergo circular movement along the annular cam groove in response to the linear movement of the piston.

16. A rotary compressor according to claim 15; wherein the piston has an engagement recess at the front portion thereof for slidably receiving therein the protrusion of the rotary disc.

17. A rotary vane-type gas compressor comprising: means defining a cylinder chamber having a peripheral inner surface and opposed closed ends; a rotor mounted to undergo rotation within the cylinder chamber and being rotationally driven during use of the compressor; a plurality of vanes slidably disposed in slots formed in the rotor such that the outer ends of the vanes make sliding contact with the cylinder chamber surface during rotation of the rotor, the vanes coacting with the rotor and cylinder chamber to define compression chambers between each two adjoining vanes; gas admitting means including an intake chamber receptive of gas under variable pressure during use of the compressor for admitting the gas into the compression chamber; an angularly displaceable valve plate having at least one valve opening therein for regulating the flow rate of the gas from the intake chamber to at least one of the compression chambers in accordance with the angular displacement of the valve plate to thereby control the compressor capacity; pressure-responsive actuating means for angularly displacing the valve plate in direct response to the variable gas pressure in the intake chamber, the pressure-responsive actuating means comprising a movable piston member connected to effect angular displacement of the valve plate in response to movement of the piston member and having a working area in communication with the intake chamber so that the variable gas pressure in the intake chamber acts directly on the working area of the piston member to urge the piston member in one direction, and biasing means for urging the piston member in the other direction; and gas discharging means for discharging compressed gas from the compression chambers.

18. A rotary vane-type gas compressor according to claim 17; wherein the piston member has another working area in communication with the ambient atmosphere so that atmospheric pressure acts on said another working area to assist the biasing means in urging the piston member in the other direction.

19. A rotary vane-type gas compressor according to claim 18; wherein the piston member has a front portion defining the working area in communication with the intake chamber, a rear portion, and a hollow interior portion in communication with the ambient atmosphere.

20. A rotary vane-type gas compressor according to claim 19; wherein the biasing means comprises a spring disposed within the hollow portion of the piston member.

* * * * *